US009325092B2

(12) United States Patent
Makino et al.

(10) Patent No.: US 9,325,092 B2
(45) Date of Patent: Apr. 26, 2016

(54) ELECTRIC CONNECTING STRUCTURE

(71) Applicant: Yazaki Corporation, Tokyo (JP)

(72) Inventors: Kimitoshi Makino, Makinohara (JP); Masahiro Takamatsu, Makinohara (JP); Shohta Yamaguchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/077,686

(22) Filed: Nov. 12, 2013

(65) Prior Publication Data

US 2014/0134886 A1 May 15, 2014

(30) Foreign Application Priority Data

Nov. 13, 2012 (JP) ..... 2012-248916

(51) Int. Cl.

| | |
|---|---|
| ***H01R 12/00*** | (2006.01) |
| ***H01R 12/72*** | (2011.01) |
| ***H01R 13/66*** | (2006.01) |
| *H01H 85/20* | (2006.01) |

(52) U.S. Cl.

CPC ..... *H01R 12/724* (2013.01); *H01R 13/6608* (2013.01); *H01H 2085/2085* (2013.01)

(58) Field of Classification Search

CPC ..... H01R 23/7068; H01R 23/7073; H01R 12/724; H01R 13/6608; B60R 16/0238; H01H 2085/208; H01H 2085/2085; H02G 3/08

USPC ..... 439/629, 76.2, 79, 949, 250, 366, 439/620.27, 620.29, 620.33, 620.34, 698, 439/830

See application file for complete search history.

(56) References Cited

U.S. PATENT DOCUMENTS

| | | | | |
|---|---|---|---|---|
| 5,030,115 | A * | 7/1991 | Regnier et al. | 439/108 |
| 5,641,295 | A * | 6/1997 | Koyama | 439/326 |
| 6,210,194 | B1 * | 4/2001 | Choy | 439/326 |
| 6,341,971 | B1 * | 1/2002 | Choy et al. | 439/326 |
| 6,666,717 | B1 * | 12/2003 | Choy | 439/541.5 |

(Continued)

FOREIGN PATENT DOCUMENTS

| | | | |
|---|---|---|---|
| CN | 102280747 | A | 12/2011 |
| JP | 2006333583 | A | 12/2006 |

OTHER PUBLICATIONS

Office Action dated Jun. 23, 2015, issued by the State Intellectual Property Office of P.R. China in counterpart Chinese Application No. 201310560174.9.

(Continued)

*Primary Examiner* — Neil Abrams
*Assistant Examiner* — Travis Chambers
(74) *Attorney, Agent, or Firm* — Sughrue Mion, PLLC

(57) ABSTRACT

An electric connecting structure includes L-shaped terminals having electric connecting portions and a resin member which contains the electric connecting portions. The L-shaped terminals are assembled to a circuit board so that a mounting direction of electric components to the resin member is substantially parallel to an extending direction of the circuit board. The electric components are mounted to the resin member in a plurality of stages which are stacked in a substantially vertical direction with respect to the extending direction of the circuit board. Mounting planes of the resin member in which the electric components are mounted to the resin member are arranged in a step-like shape so as to be displaced backward in the mounting direction by a unit of the stage in accordance with increasing of a distance from the circuit board.

8 Claims, 12 Drawing Sheets

(56) References Cited

U.S. PATENT DOCUMENTS

| | | | | |
|---|---|---|---|---|
| 6,821,144 | B2 * | 11/2004 | Choy | 439/541.5 |
| 7,733,632 | B2 * | 6/2010 | Ito | 361/626 |
| 7,927,111 | B2 * | 4/2011 | Kita | 439/76.2 |
| 2008/0268702 | A1 * | 10/2008 | Little et al. | 439/541.5 |
| 2012/0202383 | A1 * | 8/2012 | Harao | H01H 85/22 439/620.29 |
| 2013/0005194 | A1 * | 1/2013 | Ozawa | H01H 85/2035 439/698 |
| 2013/0040498 | A1 * | 2/2013 | Cai | 439/636 |

OTHER PUBLICATIONS

Office Action issued on Dec. 18, 2015, by the State Intellectual Property Office of P.R. China in counterpart Chinese Application No. 201310560174.9.

* cited by examiner

ELECTRIC CONNECTING STRUCTURE

BACKGROUND

The present invention relates to an electric connecting structure including L-shaped terminals for connecting electric components, and a resin structure, and more particularly, to the electric connecting structure which is assembled to a circuit board in such a manner that a mounting direction of the electric components is substantially parallel to the circuit board, and on which the electric components are mounted in a plurality of stages stacked in a substantially vertical direction.

As an electric apparatus to be mounted on a vehicle such as an automobile, there has been known an electric junction box, for example. The electric junction box has been known as a name generally calling a relay box, a fuse box, or a junction block, an electronic control unit box, etc.

In an electric junction box which is disclosed in JP-A-2006-333583, a plurality of loads are connected to a downstream side by way of a wire harness. The electric junction box has a function and a structure for distributing electric power or the like to a plurality of the loads. The electric junction box described in JP-A-2006-333583 will be described below.

In FIG. 11, reference numeral 101 represents an electric junction box. In this drawing, the electric junction box 101 is shown in a state where a cover member is omitted. The electric junction box 101 includes a circuit board 102, electronic components 102, connectors 104, 105 (connector blocks), a fuse block 106, an ECU connecting connector 107, and other constituent members.

The electronic components 103 are mounted on the circuit board 102. Moreover, the connectors 104, 105, the fuse block 106 and the ECU connecting connector 107 are also assembled to the circuit board 102. The electronic components 103, the connectors 104, 105, the fuse block 106 and the ECU connecting connector 107 are electrically connected to predetermined positions of a circuit pattern which is formed on the circuit board 102. The electronic components 103 are a plurality of switching transistors 108, an integrated circuit 109, and so on, which are electrically connected by way of connecting portions of their respective terminals.

The connector 104 includes a connector housing 110, and a plurality of L-shaped terminals 111. The connector housing 110, which is a resin component, has a housing body 112 adapted to be engaged with a mating connector, which is not shown, and a housing securing part to be screw-fitted to the circuit board 102. The L-shaped terminals 111 are arranged in such a manner that respective one ends thereof can be electrically connected to the mating connector, which is not shown, in a state surrounded by the housing body 112. The other ends of the L-shaped terminals 111 are passed through holes in the circuit board 102, and soldered to a predetermined circuit pattern.

The connector 105 is constructed in the same manner as the connector 104. Specifically, the connector 105 includes a connector housing 113, and a plurality of L-shaped terminals 114. The connector housing 113, which is a resin component, has a housing body 115 adapted to be engaged with a mating connector, which is not shown, and a housing securing part to be screw-fitted to the circuit board 102. The L-shaped terminals 114 are arranged in such a manner that respective one ends thereof can be electrically connected to the mating connector, which is not shown, in a state surrounded by the housing body 113. The other ends of the L-shaped terminals 114 are passed through holes in the circuit board 102, and soldered to a predetermined circuit pattern.

In FIGS. 11 and 12, the fuse block 106, which is a region where fuses of a blade type are mounted, includes a fuse cover 116, a terminal holder 117, and a group 118 of layered terminals. The fuse cover 116 and the terminal holder 117 are structures formed of resin and have insulating performance. Moreover, the group 118 of the layered terminals includes terminal groups 119 to 122 which are arranged in a state of a plurality of layers, and has electrical conductivity.

The fuse cover 116 has fuse mounting parts 123, 124, a housing 125, a connector housing 126, and a locking arm 127. The fuse mounting part 123 is arranged above the fuse mounting part 124. The housing 125 and the connector housing 126 are provided at the left side of the fuse mounting part 123. Moreover, the locking arm 127 is formed at the right side of the fuse mounting parts 123, 124.

The fuse mounting parts 123, 124 respectively have a plurality of fuse cavities 128. A plurality of the fuse cavities 128 are formed so as to be arranged in a lateral direction. The fuses are inserted into the fuse cavities 128 from a front side to a rear side thereof. The fuse mounting parts 123, 124 are arranged above and below, and at the same time, arranged in such a manner that fuse mounting planes 129 and 130 are on the same plane.

The housing 125 is formed as a region where a fusible link is to be mounted. Moreover, the connector housing 126 is formed as a connecting part of a main power supply and a power supply for an alternator.

The terminal holder 117 is formed for the purpose of holding the terminal groups 119 to 122 which compose the group 118 of the layered terminals. A locking projection 131 to be engaged with the locking arm 127 of the fuse cover 116 is formed on a side face of the terminal holder 117.

As described above, the group 118 of the layered terminals includes a plurality of the terminal groups 119 to 122. Describing them from the below to the above, the terminal group 119 is arranged in a first layer, the terminal group 120 is arranged in a second layer, the terminal group 121 is arranged in a third layer, and the terminal group 122 is arranged in a fourth layer.

The terminal group 119 in the first layer has a plurality of L-shaped terminals 132, and is formed by arranging these L-shaped terminals 132 in the lateral direction. In addition, the terminal group 119 has a power supply input terminal 133. A fork-shaped terminal portion 134 is formed at one end of each of the L-shaped terminals 132. Moreover, a bent portion 135 is formed in an intermediate area. A horizontal plate portion 136 in a shape of a plate substantially horizontal to the circuit board 2 is formed between the fork-shaped terminal portion 134 and the bent portion 135. Further, a vertical plate portion 137 in a shape of a plate substantially vertical to the circuit board 2 is formed at the other end. A pin-shaped board connecting portion 138 is formed continuously from this vertical plate portion 137.

The fork-shaped terminal portion 134 is contained and held in the fuse cavity 128 of the fuse mounting part 124 at a lower side. The vertical plate portion 137 is contained and held in the terminal holder 117. The power supply input terminal 133 is contained and held in the connector housing 126.

The terminal group 120 in the second layer has a plurality of L-shaped terminals 139, and is formed by arranging these L-shaped terminals 139 in the lateral direction. In addition, the terminal group 120 has a power supply input terminal 140. A fork-shaped terminal portion 141 is formed at one end of each of the L-shaped terminals 139. Moreover, a bent portion 142 is formed in an intermediate area. A horizontal plate portion 143 in a shape of a plate substantially horizontal to the circuit board 2 is formed between the fork-shaped terminal portion 141 and the bent portion 142. Further, a vertical plate portion 144 in a shape of a plate substantially vertical to the circuit board 2 is formed at the other end. A pin-shaped board connecting portion 145 is formed continuously from this vertical plate portion 144.

The fork-shaped terminal portion 141 is contained and held in the fuse cavity 128 of the fuse mounting part 124 at the lower side. The vertical plate portion 144 is contained and held in the terminal holder 117. The power supply input terminal 140 is contained and held in the connector housing 126.

The terminal group 121 in the third layer has a plurality of L-shaped terminals 146, and is formed by arranging these L-shaped terminals 146 in the lateral direction. In addition, the terminal group 121 has a terminal 147 for a fusible link. A fork-shaped terminal portion 148 is formed at one end of each of the L-shaped terminals 146. Moreover, a bent portion 149 is formed in an intermediate area. A horizontal plate portion 150 in a shape of a plate substantially horizontal to the circuit board 2 is formed between the fork-shaped terminal portion 148 and the bent portion 149. Further, a vertical plate portion 151 in a shape of a plate substantially vertical to the circuit board 2 is formed at the other end. A pin-shaped board connecting portion 152 is formed continuously from this vertical plate portion 151.

The fork-shaped terminal portion 148 is contained and held in the fuse cavity 128 of the fuse mounting part 123 at an upper side. The vertical plate portion 151 is contained and held in the terminal holder 117. The terminal 147 for the fusible link is contained and held in the connector housing 125.

The terminal group 122 in the fourth layer has a plurality of L-shaped terminals 153, and is formed by arranging these L-shaped terminals 153 in the lateral direction. In addition, the terminal group 122 has a terminal 154 for the fusible link. A fork-shaped terminal portion 155 is formed at one end of each of the L-shaped terminals 153. Moreover, a bent portion 156 is formed in an intermediate area. A horizontal plate portion 157 in a shape of a plate substantially horizontal to the circuit board 2 is formed between the fork-shaped terminal portion 155 and the bent portion 156. Further, a vertical plate portion 158 in a shape of a plate substantially vertical to the circuit board 2 is formed at the other end. A pin-shaped board connecting portion 159 is formed continuously from this vertical plate portion 158.

The fork-shaped terminal portion 155 is contained and held in the fuse cavity 128 of the fuse mounting part 123 at the upper side. The vertical plate portion 158 is contained and held in the terminal holder 117. The terminal 154 for the fusible link is contained and held in the connector housing 125.

By the way, in the above described related art, the fuse mounting parts 123, 124 are arranged above and below in two stages. Therefore, in the group 118 of the layered terminals, comparing lengths of the horizontal plate portion 136 and the horizontal plate portion 143 in the first and second layers with lengths of the horizontal plate portion 150 and the horizontal plate portion 157 in the third and fourth layers, the horizontal plate portions at the upper side (upper stage) are longer than those at the lower side. For this reason, there is such a problem that cost for terminal material is increased.

In addition, there is such a problem that in case where the horizontal plate portions become longer as described above, an amount of heat generation in the terminals is increased. In case where terminal material of high grade is used for the purpose of depressing the amount of heat generation, there is also such a problem that the cost for the terminal material is increased.

SUMMARY

The invention has been made in view of the above described circumstances, and it is an object of the invention to provide an electric connecting structure in which cost for terminal material can be reduced, and heat generation in the terminals can be depressed.

In order to solve the above described problem, according to the invention, there is provided an electric connecting structure comprising:

L-shaped terminals having electric connecting portions for connecting electric components respectively; and a resin member which contains the electric connecting portions, wherein the L-shaped terminals are assembled to a circuit board so that a mounting direction in which the electric components are mounted to the resin member is substantially parallel to an extending direction of the circuit board;

wherein the electric components are mounted to the resin member in a plurality of stages which are stacked in a substantially vertical direction with respect to the extending direction of the circuit board; and wherein mounting planes of the resin member in which the electric components are mounted to the resin member are arranged in a step-like shape so as to be displaced backward in the mounting direction by a unit of the stage in accordance with increasing of a distance from the circuit board.

According to the above described feature, there is provided the electric connecting structure in which the electric components are mounted in a plurality of the stages stacked in a substantially vertical direction with respect to the circuit board. In case where the electric components are mounted on such the electric connecting structure, the electric components are mounted in a manner displaced by a unit of the stage.

For example, the mounting planes of the resin member are displaced toward an interior of the circuit board in accordance with the increasing of the distance from the circuit board.

According to the above described feature, the electric components are mounted in a manner displaced to the interior of the circuit board, as going upward away from the circuit board.

For example, the electric components are fuses, and each of the electric connecting portions is formed in a shape of a fork.

According to the above described feature, the electric connecting structure is applied to the fuses, and the fuses are mounted in a manner displaced by a unit of the stage, when they are mounted.

For example, the electric components are connectors, and the resin structure is a connector housing.

According to the above described feature, the electric connecting structure is applied to the connectors, and the connectors are mounted in a manner displaced by a unit of the stage, when the connectors are mounted by connector connection.

According to the above configurations, there is provided the electric connecting structure in which the electric components are mounted in a plurality of the stages stacked in the substantially vertical direction with respect to the circuit board. When the electric components are mounted on the electric connecting structure, the electric components are mounted in a manner displaced by a unit of the stage, and therefore, it is possible to reduce a length of the L-shaped terminal by a displaced amount. As the results, reduction of cost for the terminal material and weight reduction can be advantageously achieved. Moreover, according to the invention, because the length of the L-shaped terminal is made shorter, it is possible to advantageously depress heat generation in the terminals. Further, according to the invention, because the heat generation in the terminals is depressed, it is possible to advantageously achieve the cost reduction by using the terminal material of low grade. Still further, according to the invention, because the electric components are mounted in a manner displaced by a unit of the stage, it is possible to advantageously reduce heat interference between the electric components.

According to the above configurations, the following advantage is also achieved. Specifically, it is possible to achieve such an advantage that the electric components can be easily mounted.

According to the above configurations, the following advantage is also achieved. Specifically, it is possible to achieve such an advantage that the electric connecting structure suitable to the fuses can be provided.

According to the above configurations, the following advantage is also achieved. Specifically, it is possible to achieve such an advantage that the electric connecting structure suitable to the connectors can be provided.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

In the electric connecting structure, mounting planes of electric components are arranged in a step-like shape in a manner displaced by a unit of stage, as going upward away from a circuit board.

[Embodiment]

Figure 1:
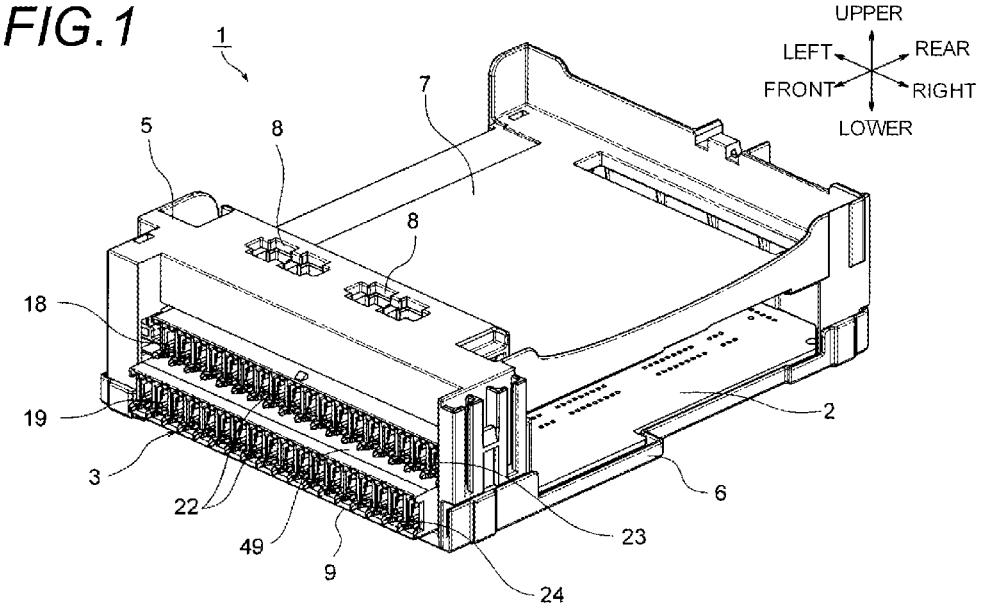
FIG. 1 is a perspective view of an electric junction box including a fuse block according to the electric connecting structure of the invention.
Figure 2:
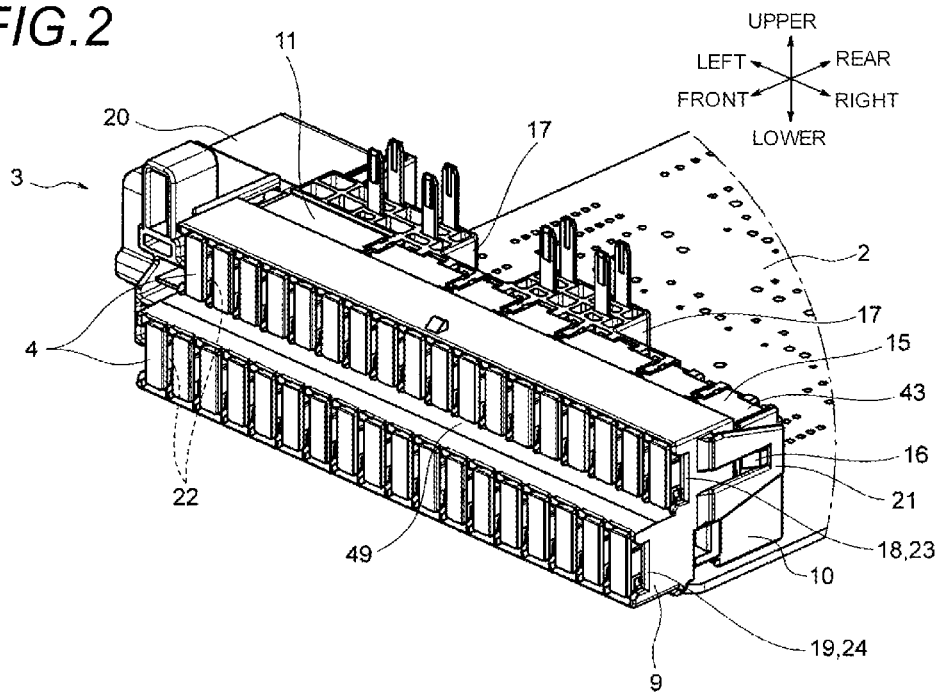
FIG. 2 is a perspective view of the fuse block.
Figure 3:
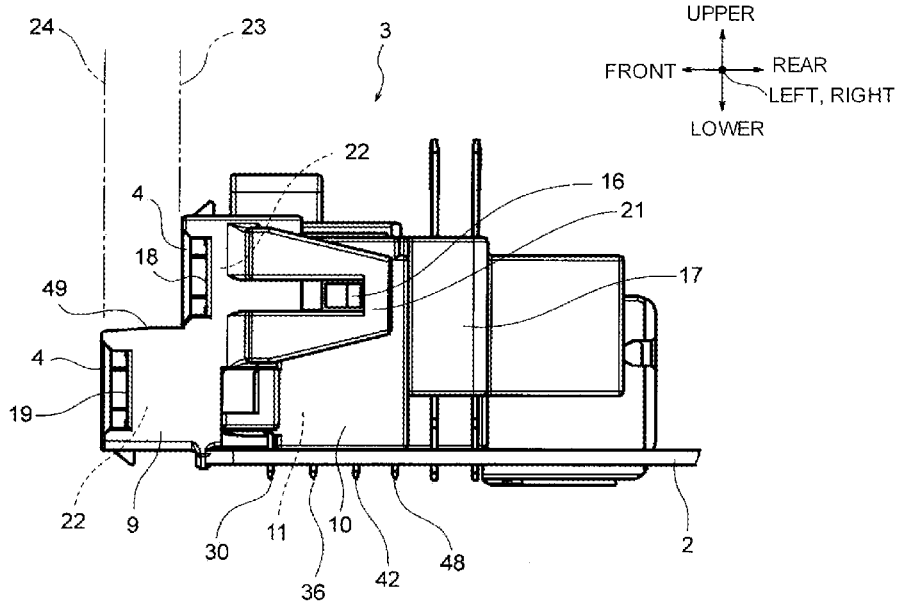
FIG. 3 is a side view of the fuse block.
Figure 4:
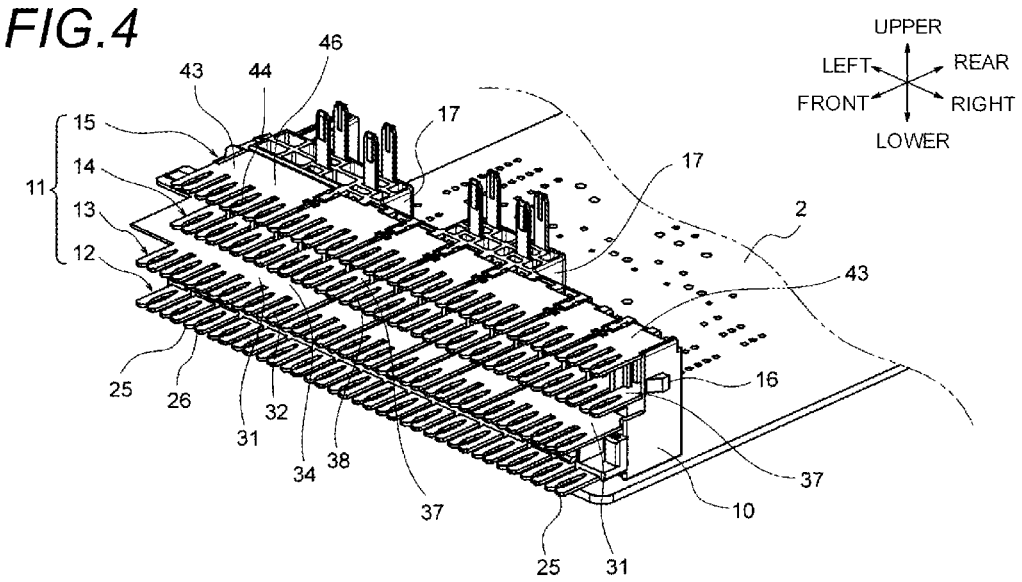
FIG. 4 is a perspective view of a group of layered terminals.
Figure 5:
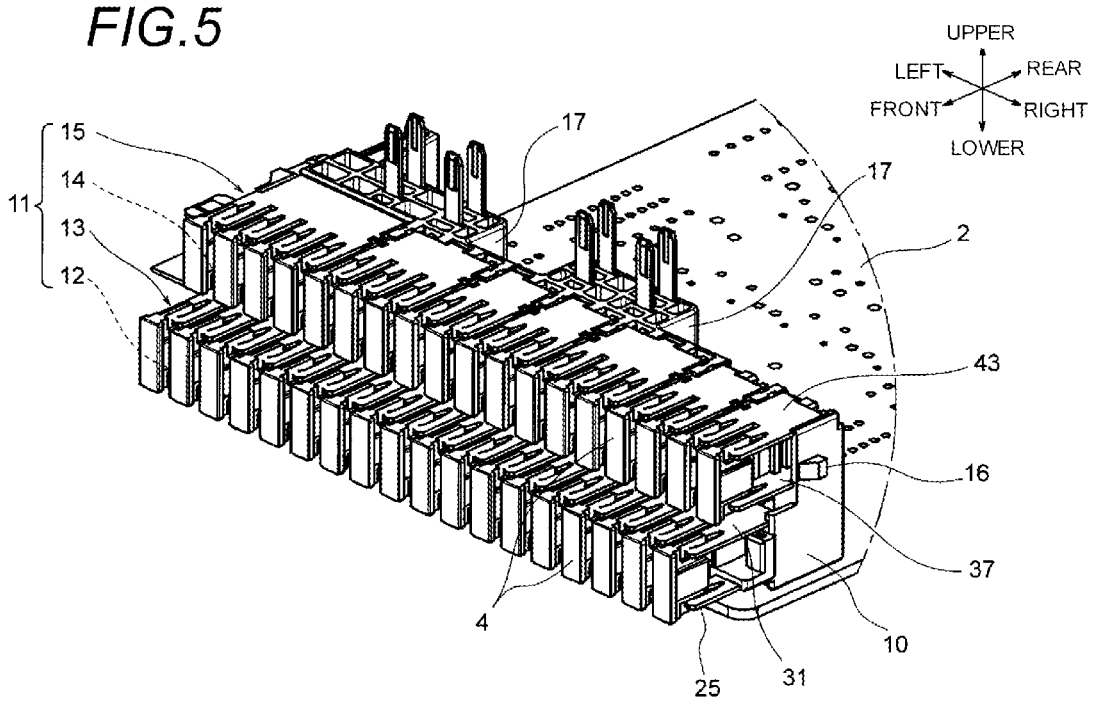
FIG. 5 is a perspective view showing a state where fuses are connected to the group of the layered terminals.
Figure 6:
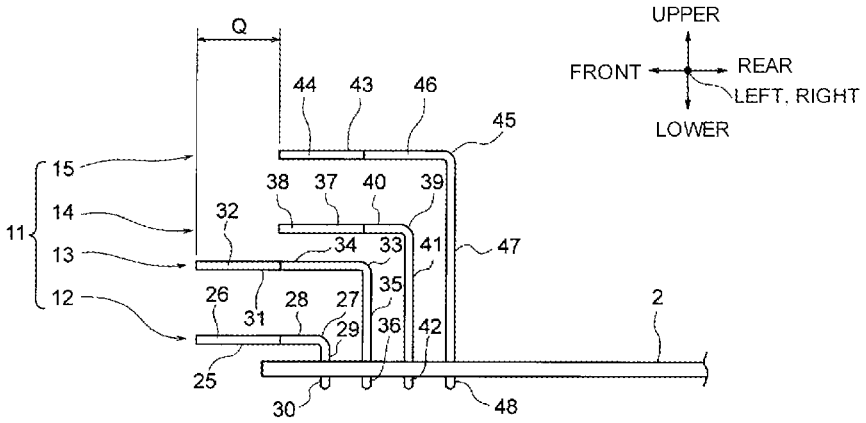
FIG. 6 is a side view of the group of the layered terminals.
Figure 7:
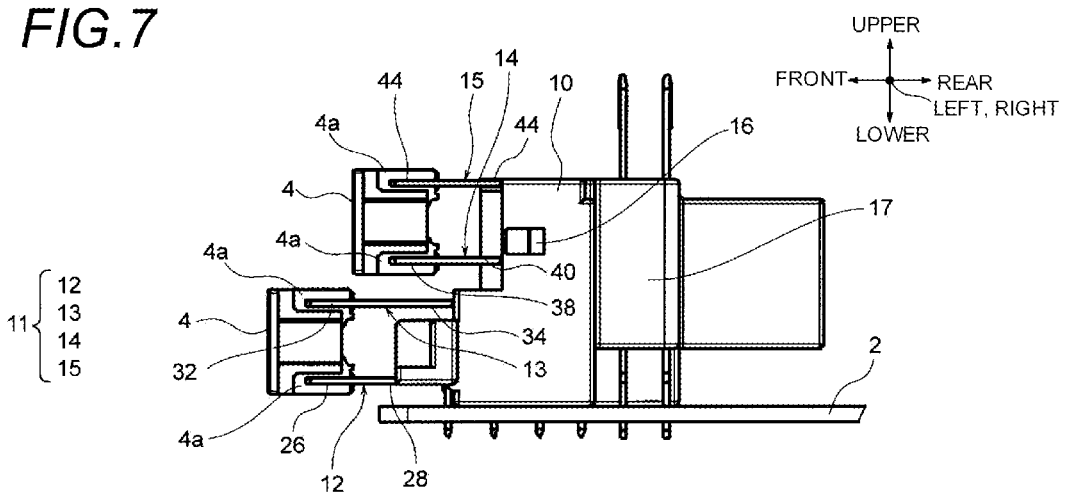
FIG. 7 is a side view showing a state where fuses are connected to the group of the layered terminals.
Figure 8:
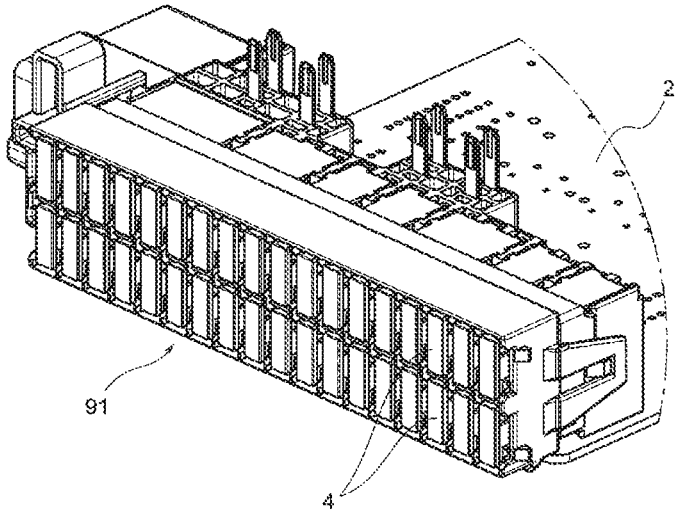
FIG.8 (RELATED ART)
FIG. 8 is a view showing a comparative example with respect to FIG. 2.
Figure 9:
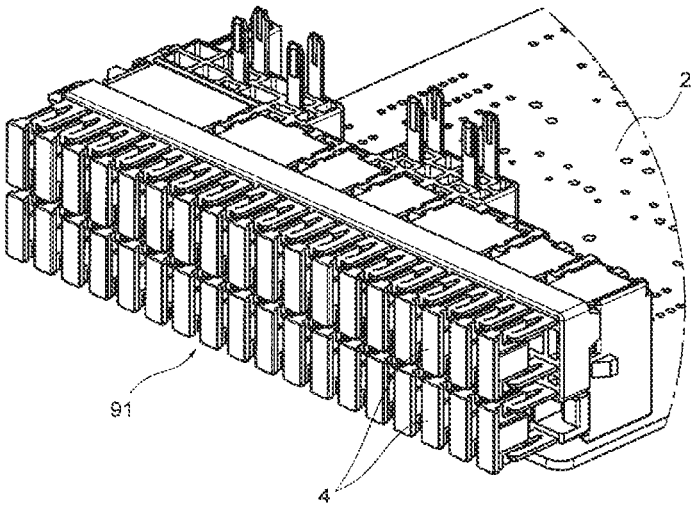
FIG.9 (RELATED ART)
FIG. 9 is a view showing a comparative example with respect to FIG. 5.
Figure 10:
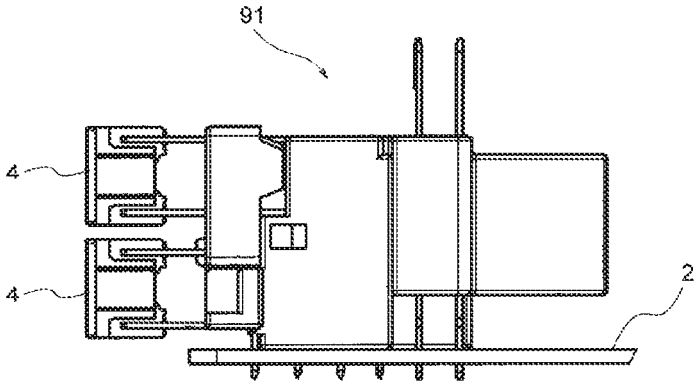
FIG. 10 (RELATED ART)
FIG. 10 is a view showing a comparative example with respect to FIG. 7.
Figure 11:
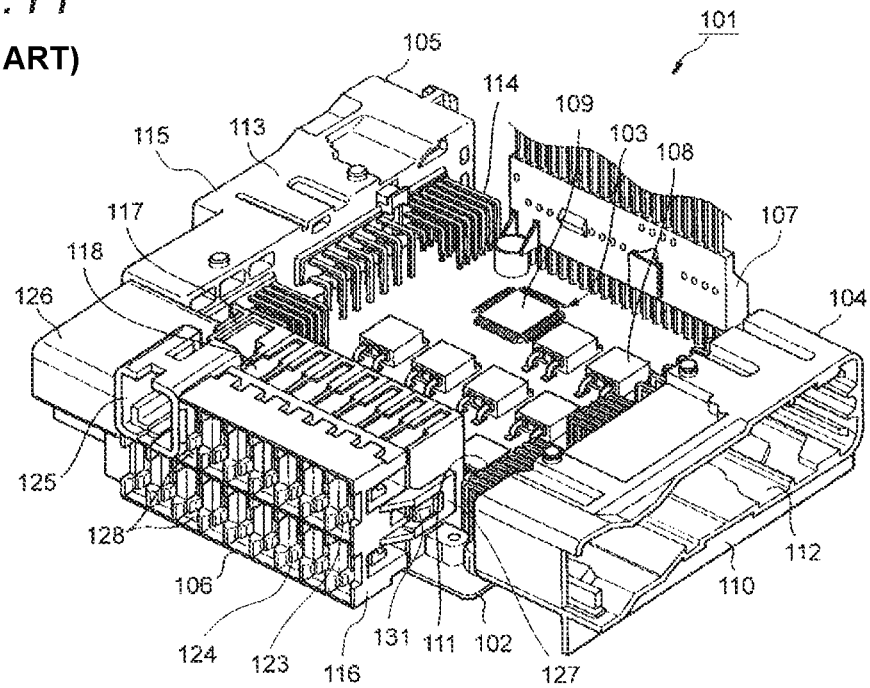
FIG. 11 (PRIOR ART)
FIG. 11 is a perspective view showing a related electric junction box.
Figure 12:
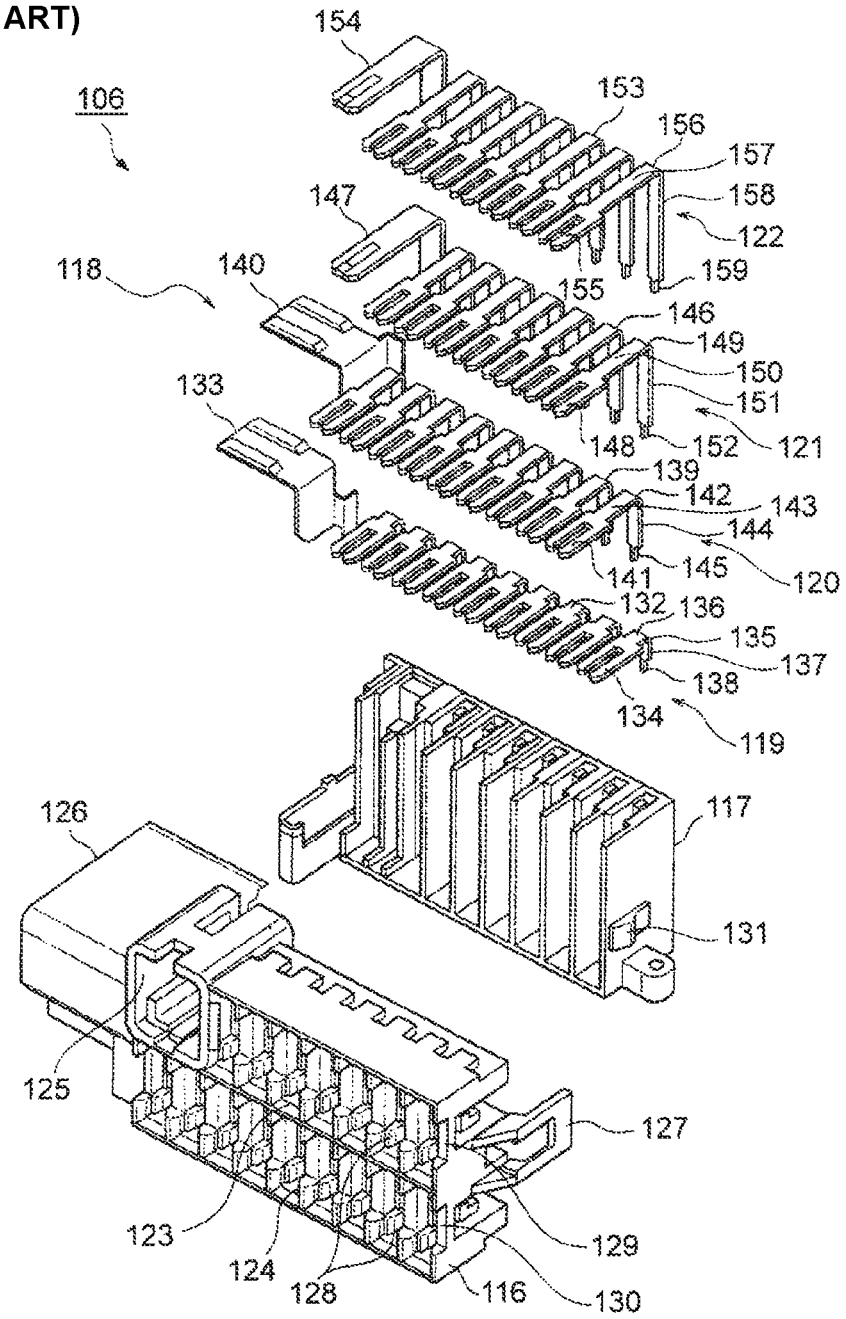
FIG. 12 (PRIOR ART)
FIG. 12 is an exploded perspective view of a fuse block in FIG. 11.

Now, referring to the drawings, an embodiment of the invention will be described. FIG. 1 is a perspective view of an electric junction box including a fuse block according to the electric connecting structure of the invention. Moreover, FIG. 2 is a perspective view of the fuse block, FIG. 3 is a side view of the fuse block, FIG. 4 is a perspective view of a group of layered terminals, FIG. 5 is a perspective view showing a state where fuses are connected to the group of the layered terminals, FIG. 6 is a side view of the group of the layered terminals, and FIG. 7 is a side view showing a state where the fuses are connected to the group of the layered terminals. Further, FIGS. 8 to 10 are views showing comparative examples.

It is to be noted that specific shapes, materials, numerical values, directions, etc. in the following description are only examples for enabling the invention to be easily understood, and can be adequately modified according to their uses, objects, specifications, etc. Moreover, although the description will be made referring to an electric junction box to be mounted on an automobile, it is also possible to apply this invention to various electrical appliances, besides the electric junction box for the automobile.

In FIG. 1, an electric junction box 1 includes a circuit board 2 on which a circuit pattern functioning as desired passages is formed, and electronic components and so on are mounted. The electric junction box 1 further includes a fuse block 3 (electric connecting structure) which is assembled to this circuit board 2, a connector block (not shown) and an ECU connecting connector (not shown) which are similarly assembled to the circuit board 2, fuses 4 (See FIG. 2) which are mounted on the fuse block 3, and an upper cover 5 and a lower cover 6 for covering an entire structure. In this embodiment, the electric junction box 1 also includes a known ECU (not shown), fusible links (not shown) etc. (only as an example). The invention is characterized in the fuse block (electric connecting structure) 3.

It is to be noted that the aforesaid ECU is assembled into a recess part 7 which is formed in the upper cover 5, and that the aforesaid fusible links are assembled to connector parts 8 which are similarly formed in the upper cover 5.

In FIGS. 2 to 5, the fuse block 3, which is a region where the fuses 4 are to be mounted, includes a fuse cover (resin member) 9, a terminal holder 10, and a group 11 of layered terminals. The fuse cover 9 and the terminal holder 10 are structures formed of resin, and have insulating performance. Moreover, the group 11 of the layered terminals includes terminal groups 12 to 15 which are arranged in four layers (in other words, arranged in four stages), and have electrical conductivity.

The fuse cover 9 is formed so as to be assembled to the terminal holder 10 in a state where the group 11 of the layered terminals is held, from a front side thereof. The terminal holder 10 has a holding part (its reference numeral is omitted) for holding the group 11 of the layered terminals, and further, a locking projection 16 to be engaged with the fuse cover 9. Moreover, the terminal holder 10 has connector housings 17 which are formed below the connector parts 8 of the upper cover 5.

The fuse cover 9 has fuse mounting parts 18, 19, a connector housing 20, and a locking arm 21. The fuse mounting part 18 is arranged above the fuse mounting part 19. The connector housing 20 is arranged at the left side of the fuse mounting part 18. Moreover, the locking arm 21 is formed at the right side of the fuse mounting parts 18, 19.

The fuse mounting parts 18, 19 respectively have a plurality of fuse cavities 22 (respectively have eighteen fuse cavities 22, in this embodiment. In short, a number of the fuse cavities 22 are provided. The number is only an example, and one each of the cavities may be formed in each of the below described "stages"). A plurality of the fuse cavities 22 are arranged in the lateral direction. Each of the fuse cavities 22 is formed in such a shape that the fuse 4 can be inserted from the front side to the rear side thereof.

The fuse mounting parts 18, 19 are arranged above and below, in a step-like shape. Specifically, they are arranged in the step-like shape having two stages in such a manner that the fuse mounting part 18 at an upper side is displaced from the mounting part 19 at a lower side in the mounting direction of the fuses 4 (the mounting direction is a longitudinal direction in the drawings).

In other words, the fuse mounting parts 18, 19 are arranged in the step-like shape in such a manner that the fuse mounting planes 23, 24 are displaced from each other in the mounting direction, as going upward away from the circuit board 2.

Although the fuse mounting parts 18, 19 are arranged in the two stages above and below in this embodiment, the number of the stages is not limited to this. The number of the stages may be three, four, and so on. As for the step-like shape, it would be sufficient that the fuse mounting part 18 at the upper side is displaced from the fuse mounting part 19 at the lower side backward in the mounting direction, that is, to an interior of the circuit board 2.

The connector housing 20 is formed as a connecting part of a main power supply and a power supply for an alternator. The locking arm 21 is formed as a part to be engaged with the locking projection 16 of the terminal holder 10.

In FIGS. 4 and 5, the group 11 of the layered terminals is formed by arranging the terminal groups 12 to 15 in the four layers, as described above (details should be referred to FIGS. 4 and 6).

The terminal group 12 in the first layer has a plurality of L-shaped terminals 25, and is formed by arranging these L-shaped terminals 25 in the lateral direction. A fork-shaped terminal portion 26 (electric connecting portion) is formed at one end of each of the L-shaped terminals 25. Moreover, a bent portion 27 is formed in an intermediate area. The fork-shaped terminal portion 26 is contained and held in the fuse cavity 22 of the fuse mounting part 19 at the lower side. The fork-shaped terminal portion 26 is connected to one of a pair of fuse terminals 4*a* which are provided on the fuse 4. The fork-shaped terminal portion 26 is formed in a shape of a tuning fork.

A horizontal plate portion 28 in a shape of a plate substantially horizontal to the circuit board 2 is formed between the fork-shaped terminal portion 26 and the bent portion 27. Further, a vertical plate portion 29 in a shape of a plate substantially vertical to the circuit board 2 is formed at the other end. A pin-shaped board connecting portion 30 is formed continuously from this vertical plate portion 29.

The terminal group 13 in the second layer has a plurality of L-shaped terminals 31 of a plurality of types, and is formed by arranging these L-shaped terminals 31 of a plurality of types in the lateral direction. A fork-shaped terminal portion 32 (electric connecting portion) is formed at one end of each of the L-shaped terminals 31. Moreover, a bent portion 33 is formed in an intermediate area. The fork-shaped terminal portion 32 is contained and held in the fuse cavity 22 of the fuse mounting part 19 at the lower side. The fork-shaped terminal portion 32 is connected to the other of a pair of the fuse terminals 4*a* which are provided on the fuse 4.

A horizontal plate portion 34 in a shape of a plate substantially horizontal to the circuit board 2 is formed between the fork-shaped terminal portion 32 and the bent portion 33. Further, a vertical plate portion 35 in a shape of a plate substantially vertical to the circuit board 2 is formed at the other end. A pin-shaped board connecting portion 36 is formed continuously from this vertical plate portion 35.

The terminal group 14 in the third layer has a plurality of L-shaped terminals 37, and is formed by arranging these L-shaped terminals 37 in the lateral direction. A fork-shaped terminal portion 38 (electric connecting portion) is formed at one end of each of the L-shaped terminals 37. Moreover, a bent portion 39 is formed in an intermediate area. The fork-shaped terminal portion 38 is contained and held in the fuse cavity 22 of the fuse mounting part 18 at the upper side. The fork-shaped terminal portion 38 is connected to one of a pair of the fuse terminals 4*a* which are provided on the fuse 4.

A horizontal plate portion 40 in a shape of a plate substantially horizontal to the circuit board 2 is formed between the fork-shaped terminal portion 38 and the bent portion 39. Further, a vertical plate portion 41 in a shape of a plate substantially vertical to the circuit board 2 is formed at the other end. A pin-shaped board connecting portion 42 is formed continuously from this vertical plate portion 41.

The terminal group 15 in the fourth layer has a plurality of L-shaped terminals 43 of a plurality of types, and is formed by arranging these L-shaped terminals 43 of a plurality of types in the lateral direction. A fork-shaped terminal portion 44 (electric connecting portion) is formed at one end of each of the L-shaped terminals 43. Moreover, a bent portion 45 is formed in an intermediate area. The fork-shaped terminal portion 44 is contained and held in the fuse cavity 22 of the fuse mounting part 18 at the upper side. The fork-shaped terminal portion 44 is connected to the other of a pair of the fuse terminals 4*a* which are provided on the fuse 4.

A horizontal plate portion 46 in a shape of a plate substantially horizontal to the circuit board 2 is formed between the fork-shaped terminal portion 44 and the bent portion 45. Further, a vertical plate portion 47 in a shape of a plate substantially vertical to the circuit board 2 is formed at the other end. A pin-shaped board connecting portion 48 is formed continuously from this vertical plate portion 47.

The fork-shaped terminal portions 26, 32, 38, 44 are arranged in the following manner. Specifically, out of the fork-shaped terminal portions 26, 32, 38, 44, the fork-shaped terminal portions 38, 44 are arranged so as to be displaced backward from the fork-shaped terminal portions 26, 32, by a distance Q. This is because the fuse mounting planes 23, 24 are arranged in a manner displaced in the mounting direction of the fuses 4 (backward, and to an interior of the circuit board), as described above.

Because the fork-shaped terminal portions 38, 44 are arranged so as to be displaced backward by the distance Q, lengths of the horizontal plate portions 40, 46 can be naturally made shorter, as compared with the related art (See FIG. 6).

As described above referring to FIGS. 1 to 7, because the length of the horizontal plate portions 40, 46 can be made shorter as compared with the related art, it is possible to advantageously achieve reduction of cost for the terminal material and weight reduction. Moreover, because the length can be made shorter as described above, it is possible to advantageously depress the heat generation in the terminals. Further, because the heat generation in the terminals is depressed, it is possible to advantageously achieve cost reduction, by using the terminal material of low grade. Still further, because the fuses 4 are mounted in a manner displaced by a unit of the stage, it is possible to advantageously decrease heat interference between the fuses 4 on the upper and lower stages.

The above described decrease of the heat interference can be easily understood, by comparing the invention with a fuse block 91 in comparative examples as shown in FIGS. 8 to 10. Specifically, the fuse block 91 in the comparative examples is formed in such a manner that the heat generated by the fuses 4 is likely to be kept therein. Therefore, it is apparent that according to the invention, the heat interference can be decreased.

Moreover, the following advantage is also achieved by adopting the invention. Specifically, the invention has a wall 49 (See FIG. 2) which is not formed in the fuse block 91 in the comparative examples. By using this wall 49 as a wall for diffusing the heat, it is possible to further decrease the heat interference, advantageously.

It is apparent that the invention can be carried out by adding various modifications within a scope not deviating from the gist of the invention.

Although the fuse 4 has been described as the electric component in this embodiment, this is not necessarily the case. Specifically, the other electric component such as a fusible link may be also used in this invention. Moreover, although the fuse block 3 has been described as the electric connecting structure, the invention may be also applied to a connector block. In this case, connectors correspond to the electric components.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-248916 filed on Nov. 13, 2012, the contents of which are incorporated herein by reference.

What is claimed is:

1. An electric connecting structure comprising:

a circuit board having a major surface; and

L-shaped terminals having horizontal plate portions which extend parallel to the major surface of the circuit board, the horizontal plate portions having electric connecting portions for connecting electric components respectively, the L-shaped terminals being assembled to the circuit board and including a first L-shaped terminal, a second L-shaped terminal, a third L-shaped terminal, and a fourth L-shaped terminal, wherein the L-shaped terminals are arranged such that a horizontal plate portion of the fourth L-shaped terminal is positioned above the horizontal plate portion of the third L-shaped terminal relative to the major surface of the circuit board, the horizontal plate portion of the third L-shaped terminal is positioned above the horizontal plate portion of the second L-shaped terminal relative to the major surface of the circuit board, the horizontal plate portion of the second L-shaped terminal is positioned above the horizontal plate portion of the first L-shaped terminal relative to the major surface of the circuit board, and a length of the horizontal plate portion of the second L-shaped terminal is greater than a length of the horizontal plate portion of the third L-shaped terminal, the electric connecting portions of the first and second L-shaped terminals extend towards and terminate at a first plane, which is perpendicular to the major surface of the circuit board, and the electric connecting portions of the third and fourth L-shaped terminals extend towards and terminate at a second plane, which is in parallel with the first plane and displaced from the first plane by a predetermined distance.

2. The electric connecting structure according to claim 1, wherein the second plane is nearer a central portion of the major surface of the circuit board than the first plane.

3. The electric connecting structure according to claim 1, wherein the electric components are fuses, and each of the electric connecting portions is formed in a shape of a fork.

4. The electric connecting structure according to claim 1, further comprising a connector housing which contains the electric connecting portions.

5. The electric connecting structure according to claim 1, wherein the electric connecting portions of the first and second L-shaped terminals extend in parallel with the major surface of the circuit board and extend towards the first plane; and wherein the connecting portions of the third and fourth L-shaped terminals extend in parallel with the major surface of the circuit board and towards the second plane.

6. The electric connecting structure according to claim 1, wherein the electric connecting portions of the first, second, third and fourth L-shaped terminals are shaped in a flat plate manner.

7. The electric connecting structure according to claim 1, wherein the predetermined distance corresponds to a length of the electric connecting portions of the first and second L-shaped terminals.

8. An electric connecting structure comprising:

a circuit board having a major surface; and

L-shaped terminals having horizontal plate portions for connecting electric components respectively, the L-shaped terminals extending parallel to the major surface of the circuit board, the L-shaped terminals being assembled to the circuit board and including a first L-shaped terminal, a second L-shaped terminal, a third L-shaped terminal, and a fourth L-shaped terminal, wherein the horizontal plate portions of the L-shaped terminals are arranged such that a horizontal plate portion of the fourth L-shaped terminal is positioned above a horizontal plate portion of the third L-shaped terminal relative to the major surface of the circuit board, such that the horizontal plate portion of the third L-shaped terminal is positioned above a horizontal plate portion of the second L-shaped terminal relative to the major surface of the circuit board, and such that the horizontal plate portion of the second L-shaped terminal is positioned above a horizontal plate portion of the first L-shaped terminal relative to the major surface of the circuit board, the electric connecting portions of the first and second L-shaped terminals extend towards and terminate at a first plane, which is perpendicular to the major surface of the circuit board, the electric connecting portions of the third and fourth L-shaped terminals extend towards and terminate at a second plane, which is in parallel with the first plane and displaced from the first plane by a predetermined distance, and a heat diffusing barrier positioned vertically between the horizontal plate portion of the third L-shaped terminal and the horizontal plate portion of the second L-shaped terminal.

* * * * *